United States Patent [19]

MacNeill et al.

[11] Patent Number: 5,027,532

[45] Date of Patent: Jul. 2, 1991

[54] REMOVABLE TRACTION CLEAT WITH REINFORCED RADIAL SUPPORT

[75] Inventors: Harris L. MacNeill, Northborough; K. Eapen Koshy, Sudbury; Thomas W. Erich, Holliston; Paul A. Latraverse, Northborough, all of Mass.

[73] Assignee: MacNeill Engineering Company, Inc., Marlborough, Mass.

[21] Appl. No.: 639,381

[22] Filed: Jan. 11, 1991

Related U.S. Application Data

[63] Continuation of Ser. No. 400,339, Aug. 30, 1989, abandoned.

[51] Int. Cl.[5] ..... A43B 5/00

[52] U.S. Cl. ..... 36/134; 36/67 D

[58] Field of Search ..... 36/134, 128, 67 R, 129, 36/67 D, 127; 411/338, 339, 500, 501, 546, 542

[56] References Cited

U.S. PATENT DOCUMENTS

| | | | |
|---|---|---|---|
| 2,722,757 | 2/1954 | Phillips | 36/67 D |
| 4,306,360 | 12/1981 | Hagger | 36/67 D |
| 4,723,366 | 2/1988 | Hagger | 36/134 |
| 4,783,913 | 11/1988 | Aoyama | 36/67 D |

*Primary Examiner*—Jimmy G. Foster
*Assistant Examiner*—Ted Kavanaugh
*Attorney, Agent, or Firm*—Bromberg & Sunstein

[57] ABSTRACT

The invention relates to traction cleats for shoes, and in particular to removable golf cleats used in golf and other field sports. The removable cleat has an improved flange design providing a rigid metal surface sufficiently close to the convex side of the reinforced radial support member to effectively engage the pins of the insertion and removal wrench. In a preferred embodiment, the flange member of the cleat has a raised lip on the concave side in the areas immediately surrounding the wrench holes so that the metal at the edges of the holes protrudes towards the convex surface of the radial support member. In another embodiment, eyelets are inserted into the wrench holes and crimped over the edges of the holes.

4 Claims, 2 Drawing Sheets

REMOVABLE TRACTION CLEAT WITH REINFORCED RADIAL SUPPORT

This a continuation of copending application Ser. No. 07/400,339 filed on Aug. 30, 1989, abandoned.

TECHNICAL FIELD

This invention relates to traction cleats for shoes, and in particular to removable golf cleats suitable for golf and other sports and field use.

BACKGROUND OF THE INVENTION

The present invention is an improvement on the traction cleat disclosed in U.S. Pat. No. 4,723,366, which is hereby incorporated herein by reference. That cleat includes a metal stud infrastructure having a vertical axis and two ends, a stem portion at a first end for engagement with a receptacle in the shoe, a head portion at a second end for tractive engagement with the ground, and a broad frusto-conical flange between the stem and head portions and extending radially outward from the vertical axis. A plastic skirt is molded directly upon the flange portion of the metal infrastructure, the resultant unitary skirt and flange forming the reinforced radial support member of the cleat. Two wrench holes remain in the radial support member for engagement with a special insertion and removal wrench.

Other cleat designs in the prior art require sufficient affixation of an all-plastic flange to an all-metal column (i.e., stem and head portions) to tolerate torque applied in insertion and removal of the cleat, axial forces exerted in use, and continual flexing of the support member relative to the rigid column. Although the cleat design of U. S. Pat. No. 4,723,366 eliminated this affixation challenge, it, like those other cleats with plastic flanges, lacks a sufficiently rigid metal surface for optimal engagement of the finger pins of the insertion and removal wrench with the sides of the wrench holes to transmit torque for insertion or removal of the cleat. The metal surface of the flange of the cleat in U.S. Pat. No. 4,723,366 is too far from the head-side surface of the support member to provide optimal engagement with the wrench pins.

DISCLOSURE OF THE INVENTION

The present invention is a removable cleat having an improved flange design providing a rigid metal surface sufficiently close to the convex side of the reinforced radial support member to effectively engage the pins of the insertion and removal wrench.

This invention enables easier insertion and removal of the cleat while still providing a plastic-metal reinforced radial support sufficiently attached to the column to endure the torque applied during insertion and the continual axial forces exerted in use.

In a preferred embodiment, the flange member has a raised lip on the concave side in the areas immediately surrounding the wrench holes so that the metal at the edges of the holes protrude toward the convex surface of the radial support member. In another embodiment, eyelets are inserted into the wrench holes and crimped over the edges of the holes.

BRIEF DESCRIPTION OF THE DRAWINGS

These and other features of the invention will be more readily understood by consideration of the following detailed description, taken with the accompanying drawings, in which.

DESCRIPTION OF SPECIFIC EMBODIMENTS

Figure 1:
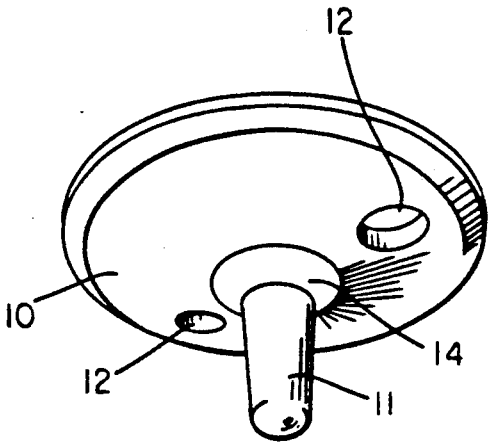
FIG. 1 is a perspective view from below of a preferred embodiment of a traction cleat in accordance with the invention.
Figure 2:
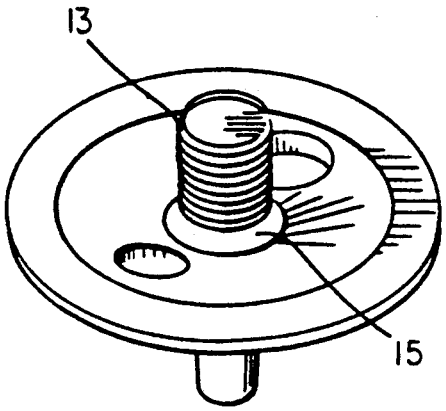
FIG. 2 is a perspective view from above of the embodiment of FIG. 1.

FIG. 1 is a perspective view of a preferred embodiment of a traction cleat in accordance with the present invention as seen generally from below, displaying ground-engaging head 11 which is frusto-conical in shape, tapering progressively toward its generally rounded-off tip. Head 11 is formed of a suitably hard metal, further discussed below, which is then through-hardened and plated for increased wear resistance. External skirt 10, generally circular in shape, is made from a suitably durable and resilient synthetic, e.g., polyurethane. Skirt 10 is slightly domed, and is seen in FIG. 1 from its convex side, from which wrench-holes 12 also can be seen. FIG. 2 shows the same cleat embodiment as in FIG. 1, but from above, with threaded stem 13 extending from the other, concave side of skirt 10, skirt 10 separating head 11 from stem 13 along the vertical column which defines a longitudinal axis. Stem 13 is generally cylindrical, with a diameter roughly equal to the wider end of frusto-conical head 11.

Figure 3:
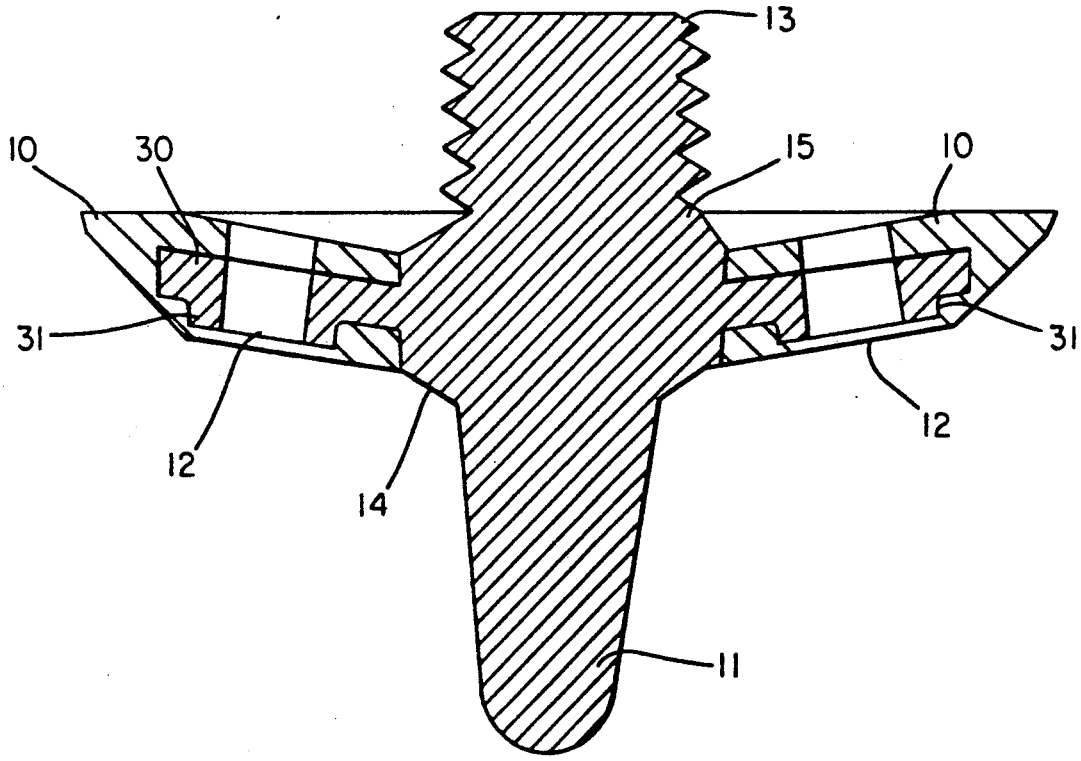
FIG. 3 is a vertical section of the embodiment.

FIG. 3 is a view of a vertical section of the cleat of FIG. 1, revealing broad, interior metal flange 30 which radiates from the vertical column in the region between head 11 and stem 13. Flange 30 is substantially encased within external skirt 10, is similarly cupped toward stem 13, and is generally circular in contour. Together, external skirt 10 and internal flange 30 form the dish-shaped, reinforced radial support structure of the cleat.

In use, the traction cleat of the present invention is inserted into an internally threaded receptacle within the sole of an athletic shoe. Specifically, stem 13 is screwed into a mated receptacle, the length of which is commonly at least substantially equal to the length of stem 13, until the perimeter of the concave surface of skirt 10 makes contact with the sole of the shoe. At this point, stem 13 has not been fully rotated up the length the threaded receptacle. With the aid of a wrench specifically designed to have fingers for insertion into wrench-openings 12, the cleat can be screwed the remainder of the distance up the socket, encountering greater resistance with each rotation as the reinforced dish-shaped support (i.e., comprising flange 30 and skirt 10) is gradually flattened against the shoe sole. The resultant backforce, created by the tendency of the support to pull down on stem 13 in order to resume its natural dome-shape, creates a lock on the threads, discouraging any inclination of the cleat to unscrew during use. This action also keeps the rim of the support in firm and continuous contact with the shoe sole when the sole flexes during normal use, thereby helping to insulate the socket against invasion by moisture or foreign materials. These locking mechanisms are specifically enhanced by the metal-reinforced support, which offers a higher degree of firmness to the generally resilient cleat in use. Furthermore, the external plastic skirt keeps the support relatively lightweight as well as rust-proof. Since interior flange 30 is integral with the vertical column, the axial forces traveling up from the head will be evenly transmitted about the metal flange, and, subsequently, further distributed to the plastic skirt via the metal-plastic interface.

To most effectively transmit torque to the cleat in insertion and removal, the fingers of the wrench should engage the rigid surface of metal flange 30. As shown in FIG. 3, providing metal close to the outer (convex side) surface of the external plastic skirt enables engagement of pins the wrench fingers with metal flange 30 even if the wrench is used at an angle, wherein the fingers do not extend far into the openings 12.

FIG. 3 thus illustrates a preferred embodiment of the invention that provides better engagement with the metal flange 30 near the convex-side surface of the radial support structure. In this embodiment, the area of the flange 30 immediately surrounding the wrench-openings 12 contains a raised lip on the concave side so that the metal at the edges of each wrench-hole 12 forms a rim 31 extending generally toward the concave side of the radial support member. These rims 31 provide a rigid surface near the convex surface of the skirt 10 to engage the fingers of an inserted wrench. Rims 31 are contained within skirt 10 so as to be protected from rust.

In assembly, flange 30 and the central column piece are cold-formed into a unitary structure, with the aid of collars 14 and 15 which lock flange 30 to the column. The column is preferably of high- or medium-carbon steel, and flange 30 of low-carbon steel. Once formed, the entire metal infrastructure is through-hardened and plated, preferably with zinc or cadmium, for extra durability. Stainless steel can be substituted in the column, although at greater expense, making the entire cleat rust-proof.

Flange 30 is cupped slightly upward toward stem 13. In manufacture, external skirt 10 is then molded directly onto flange 30 by means well known in the art, and together with flange 30 forms the dome-shaped support of the cleat. Diametrically opposed wrench-openings 12 on flange 30 are retained during the molding of skirt 10, as seen in FIGS. 1 and 2, for use with a cleat wrench. The remaining flange holes 12*a* serve as bonding holes for the molding of skirt 10 onto flange 30, and these are interrupted during the molding process.

Figure 4:
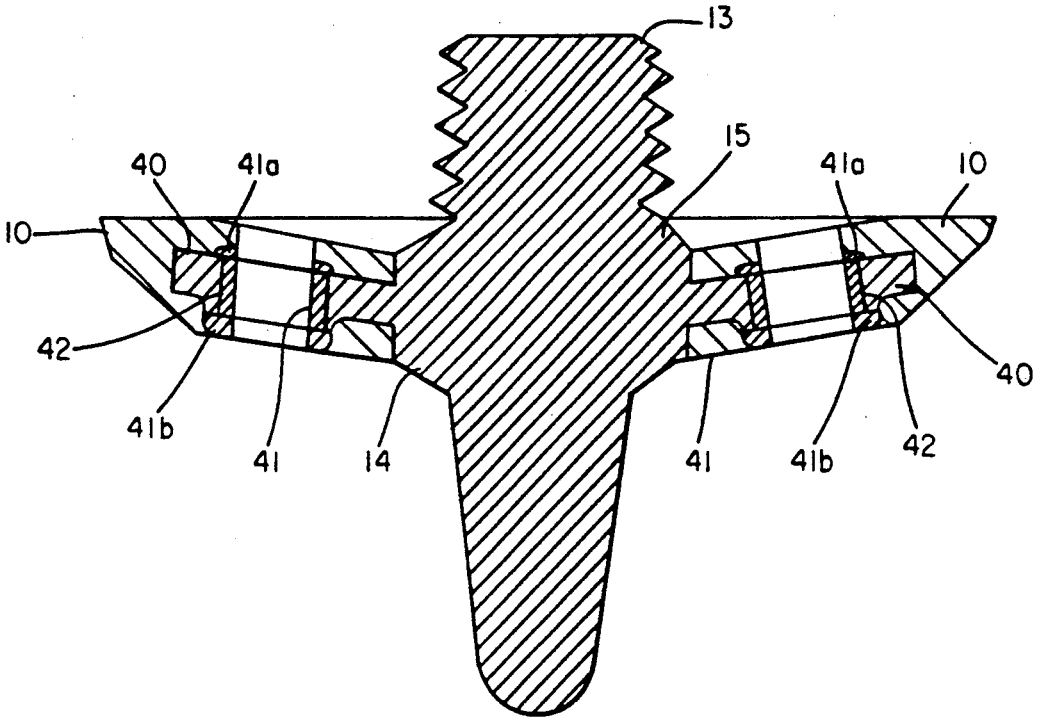
FIG. 4 is a view of a vertical section of another preferred embodiment of the invention.
Figure 5:
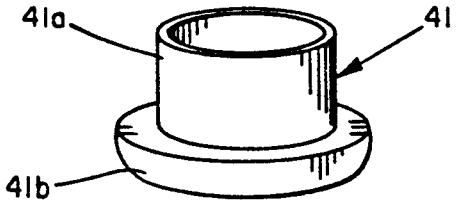
FIG. 5 is a perspective view of an eyelet used in the embodiment of FIG. 4.

FIG. 4 illustrates an alternative embodiment of the invention. The internal flange 40 includes openings (corresponding to wrench openings 12 in FIG. 3) that are slightly larger than in the first embodiment. Metal eyelets 42 are inserted into these openings in flange 40. As shown in FIG. 5, each eyelet includes a first portion 41*a* with an outer diameter generally almost equal to that of the opening in the flange 40 and a second portion 41*b* having a diameter somewhat larger than that of the opening in flange 40. The first portion 41*a* of each eyelet passes through the opening and is crimped over the edges of the opening on the concave side of flange 40, while the second portion 41*b* extends downwardly from the convex side of flange 40. The eyelets 42 provide a rigid surface near the convex surface of skirt 10 to engage the fingers of a cleat wrench. Eyelets 42 are contained within skirt 10 so as to be protected from rust.

Although the openings described above are circular, the invention is applicable to openings of any desired shape. Furthermore, although the eyelets are shown in FIG. 4 to be crimped at end 41*a*, such crimping is optional, and the eyelets may be held in place by the molded plastic skirt 10 by itself. Alternatively, the portion 41*b* may protrude through the plastic skirt and be crimped on the outside. Similarly, the number of openings for engagement by fingers of the wrench is a matter of choice.

Accordingly, while the invention has been described with particular reference to specific embodiments thereof, it will be understood that it may be embodied in a variety of forms diverse from those shown and described without departing from the spirit and scope of the invention as defined by the following claims.

What is claimed is:

1. A traction cleat for removable attachment to the underside of footwear, comprising:

(a) a metal infrastructure, having a vertical axis and first and second ends, the infrastructure including i. at the first end, engagement means for removable engagement with a mating receptacle, ii. at the second end, a ground-engaging head portion, iii. a flange member extending radially outward from a region between the engagement means and the head portion along the vertical axis, iv. a plurality of first openings located in the flange member, and v. a rim around each of the openings extending from the flange member generally vertically in the direction of the second end of the infrastructure; and (b) a plastic flange-supporting skirt substantially encasing the flange member of the infrastructure, and forming with the flange member a reinforced radial support member such that forces acting on the head portion are distributed across the flange and the plastic flange-supporting skirt when the engagement means is in engagement with the mated receptacle, the skirt containing a second opening in communication with each of the first openings in the flange member, thereby providing access through the radial support member for engagement thereof by an insertion and removal wrench, wherein each rim is a raised lip, having substantial height and substantial width, in the area of the flange member immediately surrounding each first opening.

2. A traction cleat in accordance with claim 1, wherein the axial support member is dish-shaped, having concave and convex sides, and wherein the engagement means extends from the concave side thereof.

3. A traction cleat in accordance with claim 2 wherein the rim is formed as a raised lip in the areas of the flange member immediately surrounding the first openings from the concave sides of the flange member.

4. A traction cleat for removable attachment to the underside of footwear, the cleat comprising:

(a) a metal infrastructure, having a vertical axis and first and second ends, the infrastructure including i. at the first end, engagement means for removable engagement with a mating receptacle, ii. at the second end, a ground-engaging head portion, iii. a flange member extending radially outward from a region between the engagement means and the head portion along the vertical axis, iv. a plurality of first openings located in the flange member, and v. a rim around each of the openings extending from the flange member generally vertically in the direction of the second end of the infrastructure; and (b) a plastic flange-supporting skirt substantially encasing the flange member of the infrastructure, and forming with the flange member a reinforced radial support member such that forces acting on the head portion are distributed across the flange and the plastic flange-supporting skirt when the engagement means is in engagement with the mated receptacle, the skirt containing a second opening in communication with each of the first openings in the flange member, thereby providing access through the radial support member for engagement thereof by an insertion and removal wrench, wherein i. the axial support member is dish-shaped, having concave and convex sides, and the engagement means extends from the concave side thereof, and ii. each rim includes an eyelet inserted through each first opening, each eyelet having a first portion with an outer diameter almost equal to the diameter of the first opening and a second portion with an outer diameter slightly larger than the diameter of the first opening, the first portion being disposed through the first opening and the second portion extending vertically from the flange member on the convex side thereof.

* * * * *